US010605129B1

(12) United States Patent
Snyder et al.

(10) Patent No.: US 10,605,129 B1
(45) Date of Patent: Mar. 31, 2020

(54) SYSTEM AND METHOD FOR MOUNTING A CAM PHASER

(71) Applicant: ECO Holidng 1 GmbH, Marktheidenfeld (DE)

(72) Inventors: John Snyder, Irving, TX (US); Daniel Sing, Murphy, TX (US); Stephen Nance, Highland Village, TX (US)

(73) Assignee: ECO Holding 1 GmbH, Marktheldenfeld (DE)

( * ) Notice: Subject to any disclaimer, the term of this patent is extended or adjusted under 35 U.S.C. 154(b) by 0 days.

(21) Appl. No.: 16/272,434

(22) Filed: Feb. 11, 2019

(51) Int. Cl.
*F01L 1/344* (2006.01)

(52) U.S. Cl.
CPC ..... *F01L 1/3442* (2013.01); *F01L 2103/01* (2013.01)

(58) Field of Classification Search
CPC . F01L 1/047; F01L 2001/0471; F01L 1/3442; F01L 2001/34423; F01L 2001/34426; F01L 2001/3443; F01L 2001/34433; F01L 1/46; F01L 2103/01; F01L 2103/02
USPC ..... 123/90.15, 90.17
See application file for complete search history.

(56) References Cited

U.S. PATENT DOCUMENTS

2012/0298058 A1* 11/2012 Fischer ..... F01L 1/3442 123/90.15
2018/0149270 A1* 5/2018 Herrmann ..... F01L 1/3442

FOREIGN PATENT DOCUMENTS

DE 102004051424 A1 12/2006

* cited by examiner

*Primary Examiner* — Jorge L Leon, Jr.
(74) *Attorney, Agent, or Firm* — Von Rohrscheidt Patents

(57) ABSTRACT

A system for mounting a cam phaser at a cam shaft of an internal combustion engine, the system including the cam phaser including a stator and a rotor that is rotatable relative to the stator; a control valve configured to adjust a phase angle of the cam shaft, wherein the control valve is configured to control a position of the rotor of the cam phaser by letting fluid flow into the cam phaser or letting fluid flow out of the cam phaser; and an assembly tool that includes at least one support device that is insertable into at least one corresponding support opening of the rotor so that a force is transferable between the rotor and the assembly tool.

14 Claims, 3 Drawing Sheets

SYSTEM AND METHOD FOR MOUNTING A CAM PHASER

FIELD OF THE INVENTION

The invention relates to a system and a method for mounting a cam phaser at a cam shaft of an internal combustion engine.

BACKGROUND OF THE INVENTION

Cam phasers are used in valve trains of internal combustion engines in order to variably adjust a phase relationship between a crank shaft and a cam shaft in an optimum manner. Systems or devices for mounting the cam phasers are well known in the art in plural embodiments.

Thus, DE 197 096 56 A1 discloses a device for adjusting a base position of a cam phaser at an internal combustion engine. Thus, the cam phaser that is to be attached at a face end of a cam shaft or a shaft to be adjusted including a component that is fixed in rotation relative the crank shaft and driven by a timing belt or a chain from the crank shaft and a component that is fixed in rotation relative to the cam shaft or the shaft to be adjusted are rotatable relative to each other by actuation pistons that are adjustable between two end positions. The cam phaser thus includes one or plural form locking and/or friction locking force transmission elements at a free face of the component that is attached at the cam shaft. During the adjustment process an auxiliary tool with complementary opposite elements for rotating the component that is attached at the cam shaft relative to the component that is attached at the crank shaft engages the force transmission elements.

DE 10 200 405 1424 A1 discloses a device for adjusting a cam shaft of an internal combustion engine, the device comprising an inner rotor that is rotatably adjusted relative to an outer rotor. Thus, the inner rotor is attached at a cam shaft by a central bolt. The inner rotor and the outer rotor thus include at least one recess for engaging a tool, wherein the inner rotor or the outer rotor are supportable torque proof at the at least one recess.

In the art recited supra the components associated with assembling the cam phaser are only provided for mounting purposes.

BRIEF SUMMARY OF THE INVENTION

Thus it is an object of the invention to improve upon a system for mounting a cam phaser recited supra and to configure the assembly in a more effective manner.

According to one aspect of the invention the object is achieved by a system for mounting a cam phaser at a cam shaft of an internal combustion engine. The system includes a cam phaser with a stator and a rotor that is rotate able relative to the stator. The system furthermore includes a control valve for adjusting a phase angle of the cam shaft, wherein the control valve is configured to control a position of the rotor of the cam phaser by letting fluid in or letting fluid out. Furthermore the system includes an assembly tool, wherein the assembly tool includes at least a support device for introduction into at least one corresponding support opening of the rotor in order to establish a force transfer between the rotor and the assembly tool. Thus the corresponding support opening of the rotor is part of at least one flow channel for the control valve through the cam phaser in order to let fluid flow into the cam phaser or out of the cam phaser.

Advantageous embodiments are provided in the claims.

The improved system for mounting the cam phaser advantageously a vane type cam phaser has the advantage that the retaining opening performs a double function. On the one hand side the retaining opening is used for placing and inserting the support device of the tool during assembly of the cam phaser. On the other hand side the retaining opening functions as an additional, independent flow channel for the control valve through the cam phaser during operation of the cam phaser. Thus, the flow channel connects e.g. pressure cavities of the cam phaser with connections of the control valve which is advantageously configured as an oil control valve. The pressure cavities are arranged between the rotor and the stator or between their vanes and provided to be loaded with the fluid, advantageously a valve oil in order to adjust the phase angle of the cam shaft. Due to the double function of the support opening the system is particularly effective.

It is another advantage of the system according to the invention for mounting the cam phaser that the support opening or plural support openings can be integrated into the rotor during production of the rotor without additional fabrication complexity. This leads to cost savings.

According to an advantageous embodiment the support opening is arranged at a free face of the rotor and the support device is provided to engage from the free face into the support opening. This arrangement facilitates access without barriers for the assembly tool with its support device to the support opening which simplifies mounting the cam phaser significantly.

In a particular advantageous embodiment the support opening is produced during sintering of the rotor. Sintering is a method for producing or converting materials. Thus, fine grain ceramic or metal materials are heated advantageously under increased pressure wherein the temperatures however remain below the melting temperature of the main components so that the configuration of the work piece is maintained. During production of the rotor from sintered metal various shapes like e.g. integrating support openings into the rotor can be provided without additional fabrication complexity. Thus, no additional expense is incurred in the fabrication process.

Advantageously the support device includes at least two plug in elements and the support opening of the rotor includes at least two corresponding pass through openings. A configuration of the retaining element with one or plural plug in elements and a corresponding configuration of the support opening as one or plural pass through openings assures centered application of the assembly tool at the rotor. Additionally the stability of the connection between the assembly tool and the rotor increases during application of a torque which prevents e.g. a sliding of the tool.

The support opening is advantageously connected in a fluid conducting manner with at least one outlet opening of the control valve. A connection of this type with the outlet opening facilitates an inflow and an outflow of the fluid, advantageously of a control oil from the control valve when a control piston of the control valve is moved into a particular position or changes its position.

According to an advantageous embodiment the geometry of the support opening is predetermined at least at a face of the rotor by a geometry of the tool. This assures a unique association of support opening and support device. Furthermore the geometry or shape determination by the tool facilitates an adaptation of the support opening to predetermined and/or commercially available tools. In view of the fact that integrating the support openings into the rotor as stated supra does not require any additional machining complexity, providing the mounting system according to the invention can be implemented in a simple and cost effective manner.

According to another advantageous embodiment a cross section of the support opening is configured for a fluid flow in the control valve. Thus the support opening has to be large enough so that the fluid that is exhausted or to be received by the control valve can be passed through with a required volume and flow velocity. Thus, an optimum cooperation of the control valve and the support device is assured.

Advantageously the material and/or the support opening of the rotor is configured for a force, in particular a torque which is required at the assembly tool for fixating the rotor at the cam shaft by a central bolt. Thus, the central bolt advantageously includes the control valve or put differently the control valve is configured as the central bolt. Configuring the material and/or the support opening for the required force for fixating the rotor helps to prevent a deformation or other damages to the rotor.

Advantageously the tool is configured with a hollow cylinder. The central bolt is insertable through the hollow cylinder. When the cam phaser is supported by the tool in an aligned position the central bolt can be accessed simultaneously. This way the cam phaser can be fixated at the cam shaft very comfortably.

Furthermore a contact disc is arranged at the cam phaser, wherein the contact disc is configured so that a support side of the tool is interlockable in the contact disc. Thus, the contact disc advantageously has a shape which is precision fitted to the tool or at least better adapted to the tool than the rotor itself alone with the at least one support opening. Thus, applying the tool is substantially facilitated. Furthermore a risk of the tool sliding while a force or a torque is applied to the support opening and the support device is significantly reduced. It is appreciated that the support side of the tool can also be designated as a face side of the tool which, however, was avoided herein in order to differentiate over the face side of the rotor.

Additionally the contact disc is advantageously rotatably supported in a locking disc. Thus, the locking disc and the contact disc advantageously form a protective layer for the rotor, wherein the locking disc is connected torque proof with the stator and the contact disc is connected torque proof with the rotor of the cam phaser. Thus, the cam phaser is well protected wherein an access to the support opening of the rotor by the tool is provided in the comfortable manner recited supra.

According to another aspect of the invention the object is achieved by a method for mounting a cam phaser according to one of the preceding embodiments. The method provides similar advantages as the system according to the invention for mounting the cam phaser and includes steps providing a tool with at least one support device and providing a cam phaser with a rotor with at least one support opening at a free face of the rotor, wherein the support opening of the rotor is part of a flow channel for the control valve through the cam phaser that facilitates letting fluid into the cam phaser or draining fluid out of the cam phaser. Furthermore, the method includes steps for torque proof connecting the tool with the rotor by inserting the support device into the support opening, aligning the rotor relative to the cam shaft and fixing the rotor at the cam shaft by a central bolt. This method facilitates mounting the cam phaser at the cam shaft in a quick and comfortable manner. Thus, providing the tool and the support opening in the rotor of the cam phaser can be performed in a very cost effective manner as recited supra.

In an advantageous embodiment of the method fixing the rotor at the cam shaft can be performed through a cavity of the tool. The cavity is configured, e.g., by a hollow cylinder. During fixing the rotor is supported by the tool in a previously aligned position. Thus, the method for mounting the cam phaser is particularly simple and efficient.

Advantageously the central bolt includes the control valve. As stated supra, the control valve is advantageously configured as the central bolt itself. An integrated arrangement of this type saves installation space.

In an advantageous embodiment of the method, the torque proof connecting includes a form locking engagement of the tool in the rotor. Thus, the support device of the tool and the corresponding support opening are precisely fitted relative to each other. This avoids that the tool slips from the rotor while a force or a torque is applied to the support opening and the support device. Furthermore, wear of the support device and the support opening is prevented.

In another advantageous embodiment, aligning the rotor relative to the camshaft moves the entire cam phaser by moving the tool. This means a torsion spring that is installed in the cam phaser, which is connected and fixed at the rotor and at the stator, is not loaded during mounting the cam phaser or adjusted with respect to its preload. Also when rotating the rotor for aligning the rotor with the camshaft, the stator co-rotates. Thus, there is no undesirable relative movement between the rotor and the stator during mounting of the cam phaser at the camshaft.

BRIEF DESCRIPTION OF THE DRAWINGS

Further advantages of the invention can be derived from the detailed description and the drawing figure. The invention is subsequently described based on embodiments with reference to the drawing figure, wherein.

DETAILED DESCRIPTION OF THE INVENTION

Figure 1:
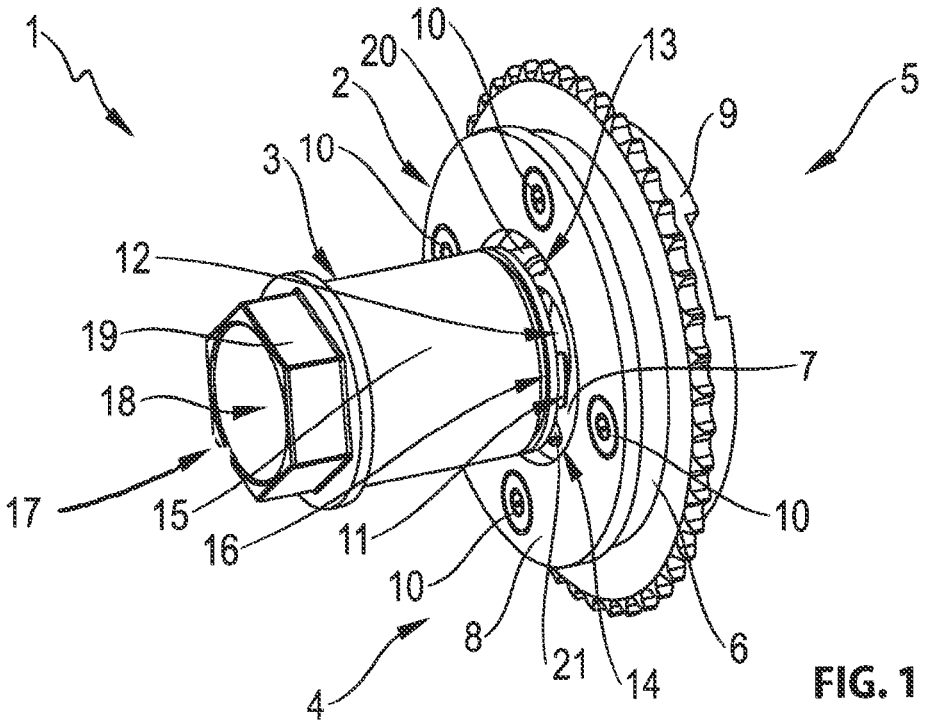
FIG. 1 illustrates a perspective view of a first embodiment of a system according to the invention for mounting a cam phaser.

FIG. 1 illustrates a system 1 for mounting a cam phaser 2 in a perspective view as a first embodiment. Thus, the system 1 includes the cam phaser 2 and an assembly tool 3. The cam phaser 2 has a front side 4 and a back side 5 and a stator 6 and a rotor 7. Furthermore, the cam phaser 2 includes a first locking disc 8 at the front side 4 and a second locking disc 9 at the back side 5 which are connected with the stator 6 by several bolted connections 10. The rotor 7 includes a central mounting opening 12 at a free face 11 of the rotor 7 and a first support opening 13 and a second support opening 14. Thus, the support openings 13, 14 are configured as pass-through openings.

The tool 3 is configured with a hollow cylinder 15 that extends from a support side 16 to a handle side 17. This hollow cylinder 15 envelops a cavity 18 which is respectively open at the support side 16 and the handle side 17. Thus, a hexagonal head 19 is configured at the handle side 17. A first support device 20 and a second support device 21 are arranged at the support side 16 wherein the support devices are configured as insertion elements and extend from the support side 16 and are inserted into the support openings 13,14 on the free face side 11 of the rotor 7. Thus, the first support device 20 is arranged inserted into the first support opening 13 and the second support device 21 is arranged inserted into the second support opening 14.

The already performed insertion of the support devices 20, 21 into the support openings 13, 14 provides a torque proof connection of the tool 3 with the rotor 7 of the cam phaser 2. In this arrangement the rotor 7 can be aligned relative to a non-illustrated camshaft by rotating the tool 3 about its axis. Thus, not only the rotor 7 but also the entire cam phaser 2 co-rotates. The hexagonal head 19 can thus be used to apply a tool like, e.g., an open end wrench. As soon as the rotor 7 is aligned relative to the camshaft, a central bolt that is also not illustrated can be inserted from the handle side 17 of the tool 3 into the cavity 18, can be inserted through the hollow cylinder 15 or can be loosely preassembled into the rotor and camshaft prior to tool engagement. Subsequently, the rotor 7 is fixable or boltable to the camshaft by the central bolt.

After mounting the tool 3 is to be pulled off from the rotor 7, which releases or makes the support openings 13, 14 available for their second function as an element of a flow channel for a control valve through the cam phaser 2. The central bolt and the control valve are subsequently described in more detail.

Figure 2:
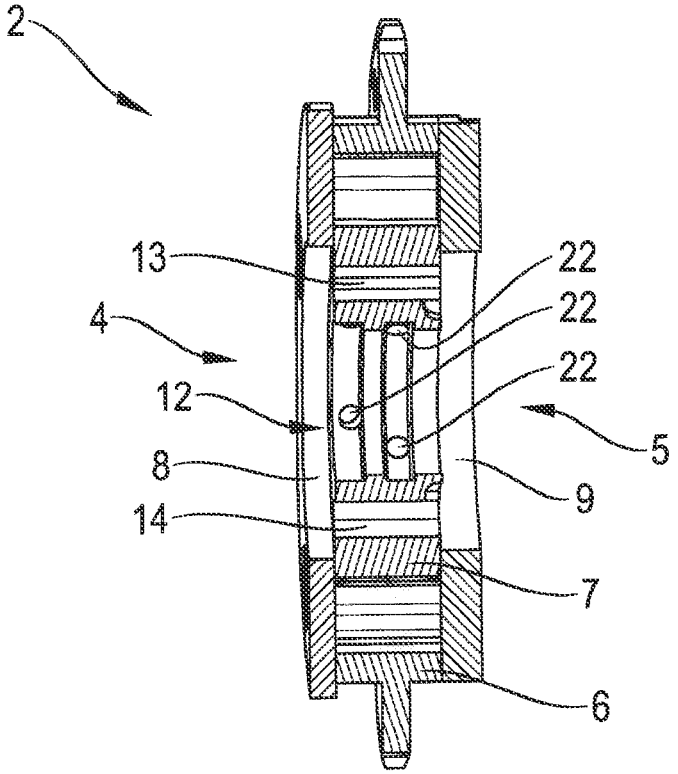
FIG. 2 illustrates a central longitudinal sectional view of the cam phaser according to FIG. 1.

FIG. 2 illustrates a longitudinal sectional view of the cam phaser 2 of FIG. 1. Out of the components illustrated in FIG. 1, FIG. 2 shows the stator 6, the rotor 7 with its mounting opening 12 and the two support openings 13, 14, and the first locking disc 8 arranged on the front side 4 and the second locking disc 9 arranged on the backside 5. Additionally all openings 22 are illustrated.

The support openings 13, 14 are furthermore clearly visible as pass-through openings or pass-through conductors which extend through the rotor 7 in its entirety. The functions and the support openings were already described in the description of FIG. 1 and are therefore not repeated.

Figure 3:
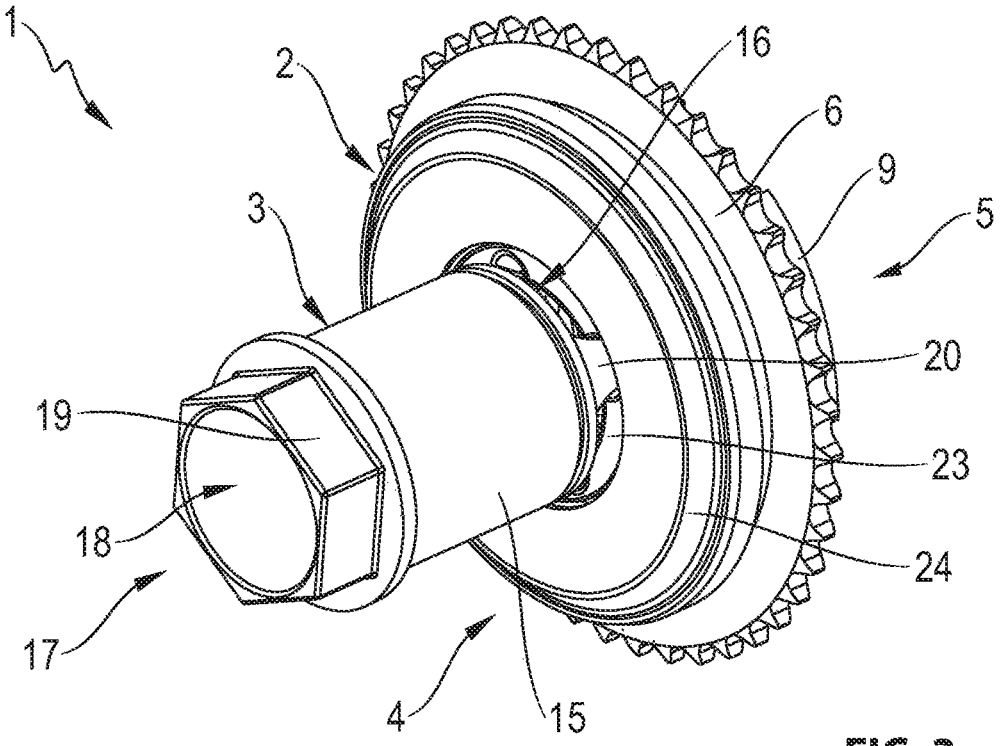
FIG. 3 illustrates a perspective view of a second embodiment of a system according to the invention for mounting a cam phaser.

FIG. 3 shows a system 1 for mounting a cam phaser 2 in a perspective view showing a second embodiment. Thus, the system 1 also includes the cam phaser 2 and a tool 3. The use of the tool 3 is to resist torque while the central bolt 27 is being tightened. Alternatively or simultaneously, the tool 3 can be used for the installation of the cam phaser onto the cam.

The cam phaser 2 includes all components of the cam phaser 2 according to FIG. 1, though not all of these components are visible in FIG. 3. A stator 6 as well as a second locking disc 9 is visible that is arranged on the back side 5. However, the cam phaser 2 illustrates a contact disc 23 and a protective cap 24 at the front side 4.

The tool 3 corresponds to the tool 3 of FIG. 1. Due to a slightly different perspective, however, only a first support device 20 is visible at a support side 16 of the tool 3. Otherwise the tool 3 is also configured in this case with a hollow cylinder 15 which extends from a support side 16 to a handle side 17. This hollow cylinder 15, in turn, envelopes a cavity 18 which is open respectively at the support side 16 and the handle side 17, wherein a hexagonal head 19 is configured at the handle side 17. Thus the tool 3 contacts the contact disc 23 with its support side 16.

Mounting the cam phaser 2 is performed in principle as already described for the system 1 in FIG. 1. However, interlocking the tool 3 in the rotor 7 is facilitated for the cam phaser 2 in FIG. 3 or an interlocking of the support devices 20, 21 in the support openings 13, 14 is facilitated by the contact disc 23. The configuration and the function of the contact disc 23 is discussed in more detail in the description of FIG. 4.

Figure 4:
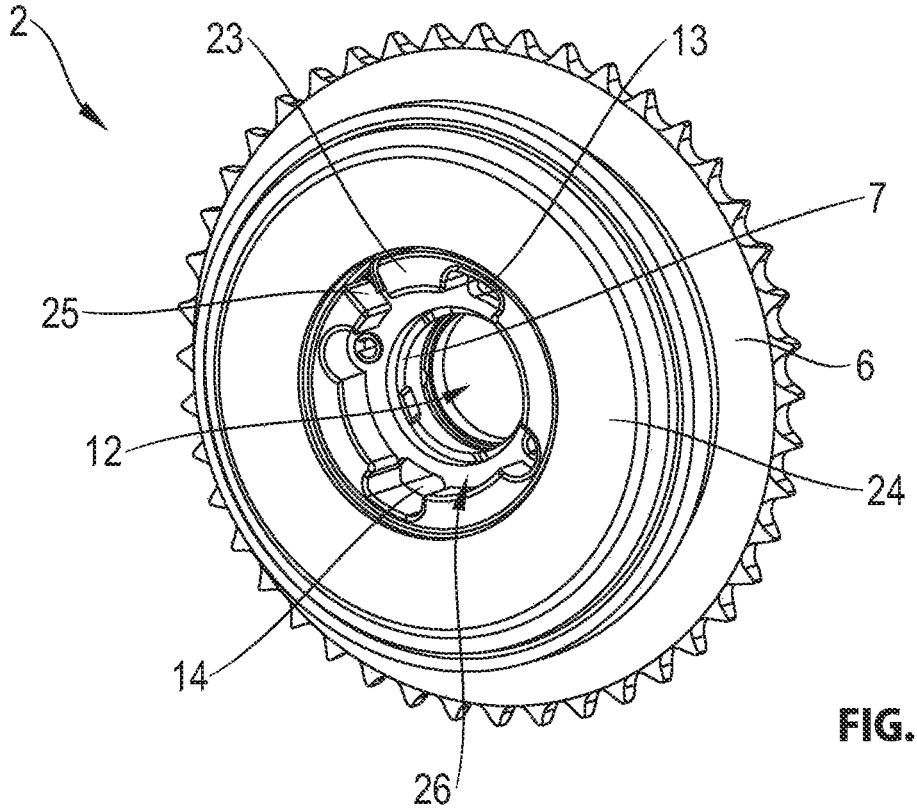
FIG. 4 illustrates a perspective view of the cam phaser according to FIG. 3.

FIG. 4 illustrates the cam phaser 2 of FIG. 3 in a perspective view, however, without the tool 3. Thus, the contact disc 23 is now illustrated to a larger extent. The stator 6 and the protective cap 24 are clearly visible. Additionally a rotor 7, a mounting opening 12, and a first supporting opening 13 and a second support opening 14 are visible. Thus, the contact disc 23 is configured adapted to the openings 12, 13, 14 of the rotor 7. Additionally the contact disc 23 includes an arresting notch for engaging a torsion spring and a centrally arranged recess 26. Additional components of the cam phaser 2 are not visible in FIG. 4 due to the chosen perspective.

As recited supra, the contact disc 23 facilitates interlocking the tool 3 of FIG. 3 in the rotor 7. Thus, a specially adapted configuration of the recess 26 in the contact disc 23 facilitates a sliding of the support devices 20, 21 of the tool 3 of FIG. 3 into the support openings 13, 14. Furthermore, the configuration of the recess 26 provides a form locking or at least improved contact of the tool 3 at the cam phaser 2.

Figure 5:
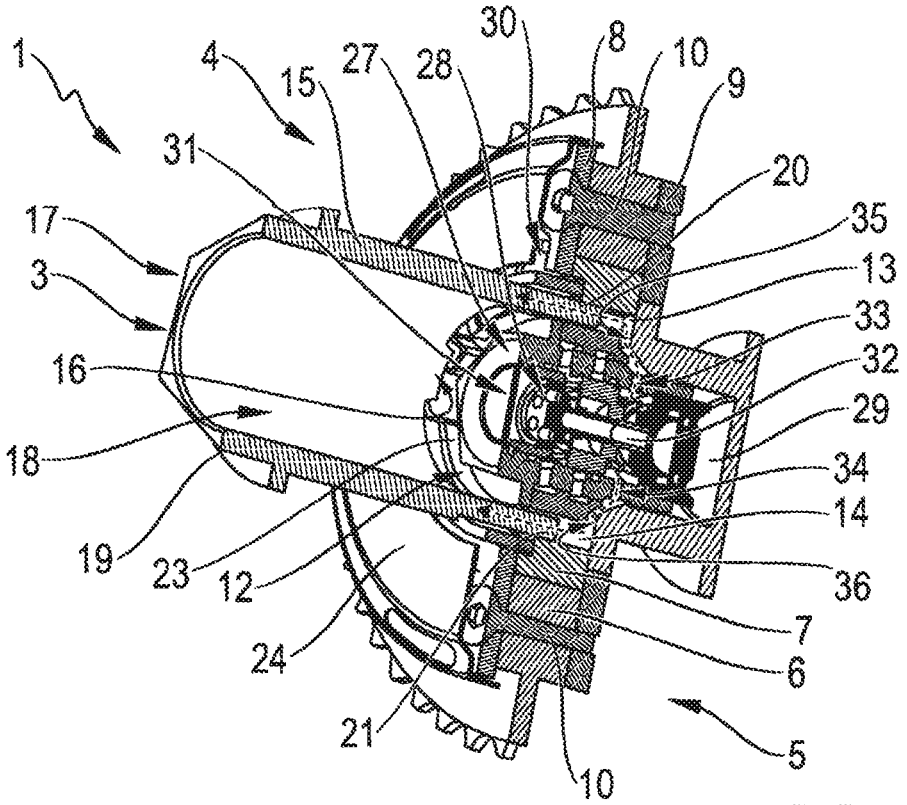
FIG. 5 illustrates a central longitudinal sectional view of the system according to FIG. 3 with a central bolt including a control valve and a cam head.

FIG. 5 illustrates a longitudinal sectional view of the system 1 of FIG. 3, wherein the cam phaser 2 is already fixed at a cam head 29 by a central bolt 27, which includes a control valve 28. Components of the cam phaser 2 are the stator 6, the rotor 7 with its mounting opening 12, and the two support openings 13, 14. Visible components are. Additionally FIG. 5 illustrates locking disc 8 on the front side 4 and the second locking disc 9 on the back side 5 which are attached at the stator 6 by bolted connections 10 and the contact disc 23 and the protective cap 24. Additionally a torsion spring 30 is visible, wherein the torsion spring 30 envelopes the contact disc 23 and is thus arranged between the first locking disc 8 and the protective cap 24.

FIG. 5 illustrates a longitudinal sectional view of the tool 3 with the hollow cylinder 15, which extends from the open support side 16 to the open handle side 17 and which envelopes the cavity 18. The hexagonal head 19 at the handle side 17 is also visible. Differently from FIG. 3, FIG. 5 also illustrates a second support device 21 at the support side 16 of the tool 3 in addition to the first support device 20. As already illustrated in FIG. 1, the first support device 20 is inserted into the first support opening 13 and the second support device 21 is inserted into the second support opening 14 of the rotor 7.

The central bolt 27 with the included control valve 28 is subsequently viewed overall as the control valve 28 and only described in detail with reference to a few of its components. Thus, the control valve 28 includes a central piston 31, which in turn includes an axial borehole 32, from which a first outlet opening 33 and a second outlet opening 34 originate. Due to a fluid conducting connection of the outlet openings 33, 34 with the support openings 13, 14, a first flow channel 35 is arranged between the first outlet opening 33 and the first support opening 13, and accordingly a second flow channel 36 is configured between the second outlet opening 34 and the second support opening 14.

The cam head 29 is fixed at the cam phaser 2 by the central bolt 27 or the control valve 28. Thus, the cam head 29 forms one side of the cam shaft or represents a partial view of the cam shaft which contacts the back side 5 of the cam phaser 2 and seals the flow channels 35, 36 towards this side. The cam head 29 is part of the cam shaft and is therefore not described in more detail.

As already stated in the description of FIG. 1 and already performed in the illustrated condition of the cam phaser 2, the central bolt 27 of the control valve 28 is inserted or pushed through the hollow cylinder 15 or preassembled into position in order to fix the rotor 7 at the cam shaft, which is indicated herein by the cam shaft head 29. After assembly, thus in the illustrated condition the tool 3 can be pulled off the rotor 7. Thus, the support openings 13, 14 can now serve as elements of the flow channels 35, 36 for the fluid.

Figure 6:
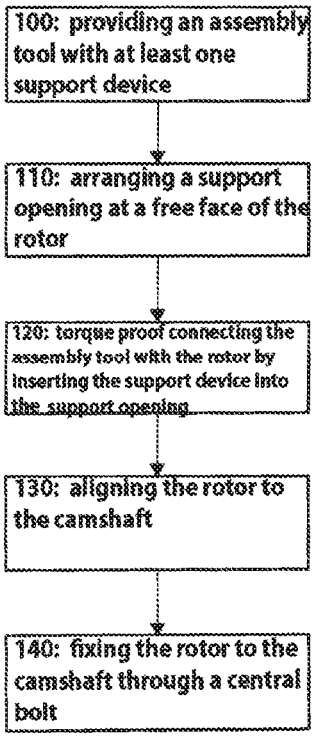
FIG. 6 illustrates a block diagram for a method for mounting a cam phaser according to the invention.

FIG. 6 illustrates a block diagram for a method for mounting a cam phaser 2 using a system 1 according to FIGS. 1 through 6. The method includes providing 100 a tool 3 with at least one support device 20, 21, providing 110 a cam phaser 2 with a rotor 7 with at least one support opening 13, 14 at a free face 11 of the rotor 7, torque proof connecting 120 of the tool 3 with the rotor 7 by inserting the support device 20, 21 into the support opening 13, 14, aligning 130 of the rotor 7 relative to the camshaft and eventually fixing 140 the rotor 7 at the camshaft by a central bolt 27. When providing 110 the cam phaser 2 the support opening 13, 14 of the rotor 7 is part of a flow channel 35, 36 between the control valve 28 and the cam phaser 2 in order to feed or drain a fluid to or from the cam phaser 2.

The use of the tool 3 is to resist torque while the central bolt 27 is being tightened. Alternatively or simultaneously, the tool 3 can be used for the installation of the cam phaser onto the cam.

What is claimed is:

1. A system for mounting a cam phaser at a cam shaft of an internal combustion engine, the system comprising:

the cam phaser including a stator and a rotor that is configured to rotate relative to the stator;

a control valve configured to adjust a phase angle of the cam shaft, wherein the control valve is configured to control a position of the rotor by letting fluid flow into the cam phaser or letting the fluid flow out of the cam phaser; and an assembly tool including at least one support device that is inserted into at least one corresponding support opening of the rotor so as to transfer a force between the rotor and the assembly tool, wherein the at least one corresponding support opening is part of at least one flow channel between the control valve and the cam phaser, and the fluid flow into the cam phaser or out of the cam phaser is conducted via the at least one flow channel.

2. The system according to claim 1, wherein the at least one corresponding support opening is arranged at a free face of the rotor and the at least one support device is configured to engage the at least one corresponding support opening at the free face.

3. The system according to claim 2, wherein a geometry of the at least one corresponding support opening is defined at least at the free face of the rotor by a geometry of the assembly tool.

4. The system according to claim 1, wherein the at least one corresponding support opening is integrally sintered in one piece together with the rotor.

5. The system according to claim 1, wherein the at least one support device includes at least two insertion elements, and the at least one corresponding support opening of the rotor includes at least two corresponding pass-through openings.

6. The system according to claim 1, wherein the at least one corresponding support opening is connected in a fluid conducting manner with at least one outlet pass-through opening of the control valve.

7. The system according to claim 1, wherein a cross-section of the at least one corresponding support opening is configured to control a fluid flow in the control valve.

8. The system according to claim 1, wherein the assembly tool includes a hollow cylinder.

9. The system according to claim 1, wherein a contact disc is arranged at the rotor, and wherein the contact disc is configured so that a support side of the assembly tool interlocks with the contact disc.

10. A method for mounting a cam phaser at a cam shaft of an internal combustion engine, the cam chaser including:

a stator and a rotor that is configured to rotate relative to the stator, and a control valve configured to adjust a phase angle of the cam shaft and to control a position of the rotor by letting fluid flow into the cam phaser or letting the fluid flow out of the cam phaser, wherein the cam phaser is configured to receive an assembly tool, the assembly tool including at least one support device that is inserted into at least one corresponding support opening of the rotor so as to transfer a force between the rotor and the assembly tool, and wherein the at least one corresponding support opening is part of at least one flow channel between the control valve and the cam phaser, and the fluid flow into the cam Phaser or out of the cam phaser is conducted via the at least one flow channel, the method comprising:

arranging the at least one corresponding support opening at a free face of the rotor;

torque proof connecting the assembly tool with the rotor by inserting the at least one support device into the at least one corresponding support opening;

aligning the rotor relative to the cam shaft; and fixing the rotor to the cam shaft with a central bolt.

11. The method according to claim 10, wherein the fixing of the rotor to the cam shaft is performed through a cavity of the assembly tool.

12. The method according to claim 10, wherein the central bolt includes the control valve.

13. The method according to claim 10, wherein the torque proof connecting includes a form-locking engagement of the assembly tool in the rotor.

14. The method according to claim 10, wherein the aligning of the rotor relative to the cam shaft includes moving the cam phaser in fully assembled form via the assembly tool.

* * * * *